US009610219B1

(12) United States Patent
Basso

(10) Patent No.: US 9,610,219 B1
(45) Date of Patent: Apr. 4, 2017

(54) SYSTEM FOR PERFORMING A UNITIZING DOSE PROCESS OF BLISTER PACKS

(71) Applicant: Victor Basso, Sao Pablo (BR)

(72) Inventor: Victor Basso, Sao Pablo (BR)

( * ) Notice: Subject to any disclaimer, the term of this patent is extended or adjusted under 35 U.S.C. 154(b) by 136 days.

(21) Appl. No.: 14/556,702

(22) Filed: Apr. 23, 2015

(51) Int. Cl.
*A61J 1/03* (2006.01)
*B65B 61/06* (2006.01)
*B26D 7/06* (2006.01)

(52) U.S. Cl.
CPC ..... *A61J 1/035* (2013.01); *B26D 7/0675* (2013.01); *B65B 61/06* (2013.01)

(58) Field of Classification Search
CPC ..... Y10T 83/2216; Y10T 83/0443; Y10T 83/0453; Y10T 83/0505; Y10T 83/207; Y10T 83/5669; Y10T 83/5815; Y10T 83/6476; Y10T 83/7487; Y10T 83/7593; Y10T 83/9411; Y10T 83/9423; Y10T 83/9476; A61J 1/035; A61J 1/03; B26D 7/0675; B26D 7/00; B26D 5/00; B65B 61/06; B65B 61/065; B26F 1/00; B26F 1/02; B26F 1/38; B26F 1/44; B26F 2210/06; B26F 2210/11
See application file for complete search history.

(56) References Cited

U.S. PATENT DOCUMENTS 4,428,709 A * 1/1984 Peters ..... B65B 69/0058 128/203.15
4,975,015 A * 12/1990 Harding ..... B65B 69/0033 206/532
5,630,347 A * 5/1997 Elvio ..... G07F 11/68 74/665 GE
5,699,709 A * 12/1997 Scheifele ..... B26D 7/01 83/236
6,318,051 B1 * 11/2001 Preiss ..... B65B 5/103 53/237
8,157,125 B2 * 4/2012 Schiff ..... B65B 69/0058 221/197
2011/0132163 A1 * 6/2011 Deutsch ..... B26D 5/007 83/78
2013/0133489 A1 * 5/2013 Este ..... B26D 5/007 83/13

* cited by examiner

*Primary Examiner* — Phong Nguyen

(57) ABSTRACT

A unidose blister cutting machine comprises a cartridge for holding blister packs, a first positioning arm for pushing a blister pack in a first direction, a second positioning arm for pushing the blister pack in a second direction substantially orthogonal to the first direction, a flipping robotic arm having a suction means for retaining the blister pack during a flipping movement, a grabbing jaw for grabbing the blister pack from the flipping robotic head, a cutting device, and a collecting chute located below the cutting device for collecting the cut blister packs.

12 Claims, 8 Drawing Sheets

SYSTEM FOR PERFORMING A UNITIZING DOSE PROCESS OF BLISTER PACKS

BACKGROUND OF THE INVENTION

Field of the Invention

The present invention is referred to a system for cutting and separating in individual doses the medicaments usually packed in a blister pack. The invention is, however, more particularly directed to a system to be used by hospital pharmacies, nursing homes, drug distribution centers, etc. to individually cut, separate, pack and identify drugs.

Background of the Invention

A blister pack is a type of packaging in which a product is sealed in plastic, often with a cardboard backing. Blister pack is a term for several types of pre-formed plastic packaging used for small consumer goods, foods, and for pharmaceuticals.

The main component of a blister pack is a cavity or pocket made from a formable thermoformed plastic. This usually has a backing of paperboard or a lidding seal of aluminum foil or plastic. A blister pack that folds onto itself is often called a clamshell.

Blister packs are commonly used as unit-dose packaging for pharmaceutical tablets, capsules or lozenges. Blister packs can provide barrier protection for shelf life requirements, and a degree of tamper resistance. In the USA, blister packs are mainly used for packing physician samples of drug products, or for over the counter (OTC) products in the pharmacy. A series of blister cavities is sometimes called a blister card or blister strip as well as a blister pack. These types of packaging have two key properties:

(i) the lidding foil is brittle; allowing to press the product out while breaking the lidding foil and;

(ii) a semi-rigid formed cavity being sufficiently collapsible to be able to dispense the tablet or capsule by means of pressing it out with the thumb.

The main advantages of unit-dose blister packs over other methods of packing pharmaceutical products are the assurance of product/packaging integrity (including shelf life) of each individual dose and the possibility to create a compliance pack or calendar pack by printing the days of the week above each dose.

Blister packs are created by means of a form-fill-seal process at the pharmaceutical company or designated contract packer. A form-fill-seal process means that the blister pack is created from rolls of a flat sheet or film filled with the pharmaceutical product and closed (sealed) on the same equipment. Such equipment is called a blister line. The forming film is typically made of a thermoplastic material, such as polyvinyl chloride (PVC), Polyvinylidene chloride-coated PVC (PVDC), PET or aluminum foil.

The lidding material can be clear plastic, but in pharmaceutical packaging it is either plain or printed foil. Aluminum foil is most commonly the preferred material. The lidding material may also be made of a laminate of paper and foil with the foil upper surface being coated with a film of a thermoplastic material such as polyethylene or polystyrene.

Blister packs are opened, providing access to the medicament by deforming the forming film so that it punctures the lidding material and allows the medicament to be removed therefrom, without applying directly mechanical pressure to the medicament.

Hospital pharmacies usually receive blister-packed medicines. However, in a hospital, medicines are to be dispensed in the correct dose to be taken by the patient. In pharmacies, a "de-blistering" operation is therefore necessary; consisting of removing the units of medicine that are required from the blister pack, by breaking the sealing sheet, so as to put them in an intermediate container (glass, bottle) in which the medicine or medicines to be administered are taken to the patient.

A problem associated with this de-blistering process is that, although it is easy to perform by using de-blistering machines of a known type, the units of medicine may be damaged, lost or stolen during the transfer to the patient in the hospital.

Therefore, hospitals are trying to avoid this process and, instead of de-blistering the pills, they usually separate the pills individually. Pharmacies at hospitals convert these blister packs into units and identify each drug with new codes and/or names to be delivered to nurses.

Every time the hospital needs to provide a pill to a patient, the pharmacy needs to separate one pill from the blister pack. However, this separation process cannot take place by taking out the pill from the cavity, as the medicament may be contaminated or deteriorated. Therefore, the whole cavities with the pill inside need to be separated from the blister pack, usually by cutting then out with a pair of scissors. In order to cut the blister pack, the process is done manually. This process of separating individual cavities with a pair of scissors is called a "unitization dose" process.

One of the main challenges for creating a machine to separate the doses in units is because of the shape and distribution of the pills in the blister packs. In some cases, the pills are arranged in perfectly aligned pairs, in some cases the distribution defines a zigzag arrangement of the cavities with the pills, in some cases the distribution is circular, etc. The machine with scissors cannot cut other than "line cuts" so when the pills are arranged in zigzag the machine cannot cut them.

DESCRIPTION OF THE PRIOR ART

At present, hospital pharmacies perform the "unitization dose" process by cutting the blister with scissors. In some cases, there is some kind of automation process in the scissor cutting procedure.

There are some machines in the art for cutting the blister packs. For example, U.S. Pat. No. 6,318,051 discloses a device for automatically cutting pills packed in blister packs individually. The device comprises multiple blister pack storage stations in a circular arrangement. Consequently, it takes up a great deal of space. In addition, it is not a very versatile machine.

Another example is disclosed in the European Patent Application Serial No. PT20080380216T that describes a machine for handling blister packs, which comprises a first blister pack storage station provided with an opening for feeding blister packs to a second blister pack transport station for transporting the blister packs to a third station for cutting the blister packs, and an opening for transferring the cut blister packs to a delivery or packing station. This machine addresses some of the needs of the market, but it still cannot accommodate blister packs with a non-traditional distribution of pills.

Patent Application Serial No. WO2012020354 describes a device for singling out products that are grouped in blister packs or similar multiple packages. It comprises a support structure for at least one multiple package to be singled out, with a bearing surface defining a reference plane (X-Y). A clamping means can be activated selectively in order to clamp at least one multiple package against the bearing surface. A cutting head comprises a cutting unit, preferably an ultrasound unit, with means for cutting the multiple package, and the control means are operatively connected to the cutting head and to the clamping means in order to control relative movement between the cutting unit and the multiple package in accordance with a cutting scheme which is predetermined or is defined in real time, and which depends on the configuration of the multiple package.

Even though the systems for unitizing and packing drugs in hospital environments of the prior art address some of the needs of the market, a new, safe, improved and economical system for unitizing blister-packed drugs is still desired.

SUMMARY OF THE INVENTION

The present invention is referred to an automatic machine for performing the unitization process of blisters containing medicines. This machine is of the matrix and punch type, and replaces many operations of cutting blisters repeatedly. It is possible to process up to 40 blister packs at a time and the machine will take the blister pack (with information of its dimensions already loaded into its memory) by using a robotic arm to start cutting.

After being cut, the blister pack (with the medicament inside) proceeds to be packed with a secondary packing machine and labeled it to ensure a proper identification thereof. The whole process is performed and supervised by a pharmacist who is also authorized to re-pack and label the pharmaceutical drug unit. The present machine may cut 2,400 blister packs per hour, in a completely automatic way. This may be done in the hospital's central pharmacy or in an adjoining room called a unidose repackaging room.

In one general aspect of the present invention, the system is used by hospitals to perform the unidose repackaging process by individually cutting and identifying blister packs with medicines to be used by the hospital's patients.

Accordingly, it is a primary object of the present invention to provide a device capable of cutting and repackaging medicines from a blister pack.

Another aspect of the present invention provides a system that converts medical drugs into unities with identification for a safe manipulation in hospital environments.

Yet another aspect of the purposed invention comprises a unitizing dose method that allows the cutting of the blister pack in a way that avoids the creation of sharp edges that can potentially harm a nurse when the unitary dose is manipulated.

Also another aspect of this invention comprises a unitizing machine including a blister pack feeder that defines a singular way of feeding the blister to the cutting process. Two motors are used to keep the blister packs with a slight degree of pressure to the top position and to one side, in order to be taken by the rotary table softly in an exact position with no size regulation required.

Yet another aspect of the purposed invention comprises a unidose repackaging method capable of loading the information of the size and the distribution of the blister pack into a database, with which the movement of the robotic arms are controlled, in accordance with the type of blister pack that is being processed.

Yet another aspect of the purposed invention consists of a unidose blister cutting machine that uses punching dies, which are placed and extracted with no tools required.

Yet another aspect of the purposed invention comprises a unitizing dose method that places the final product at the exit of a tube, helping the repacking process.

In summary, the present invention is related to a unitizing machine comprising: a cartridge for holding the blister packs to be processed; a first positioning arm capable of pushing the blister pack in a first direction; a second positioning arm capable of pushing the blister pack in a second direction substantially orthogonal to the first direction; a flipping robotic head; this flipping robotic head including a suction means capable of retaining the blister pack during a flipping movement, and an axis coupled to a motor; a grabbing jaw capable of grabbing one blister pack at a time from the flipping robotic head; a cutting device, a collecting chute located below the cutting device capable of collecting the cut blister packs.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Figure 1:
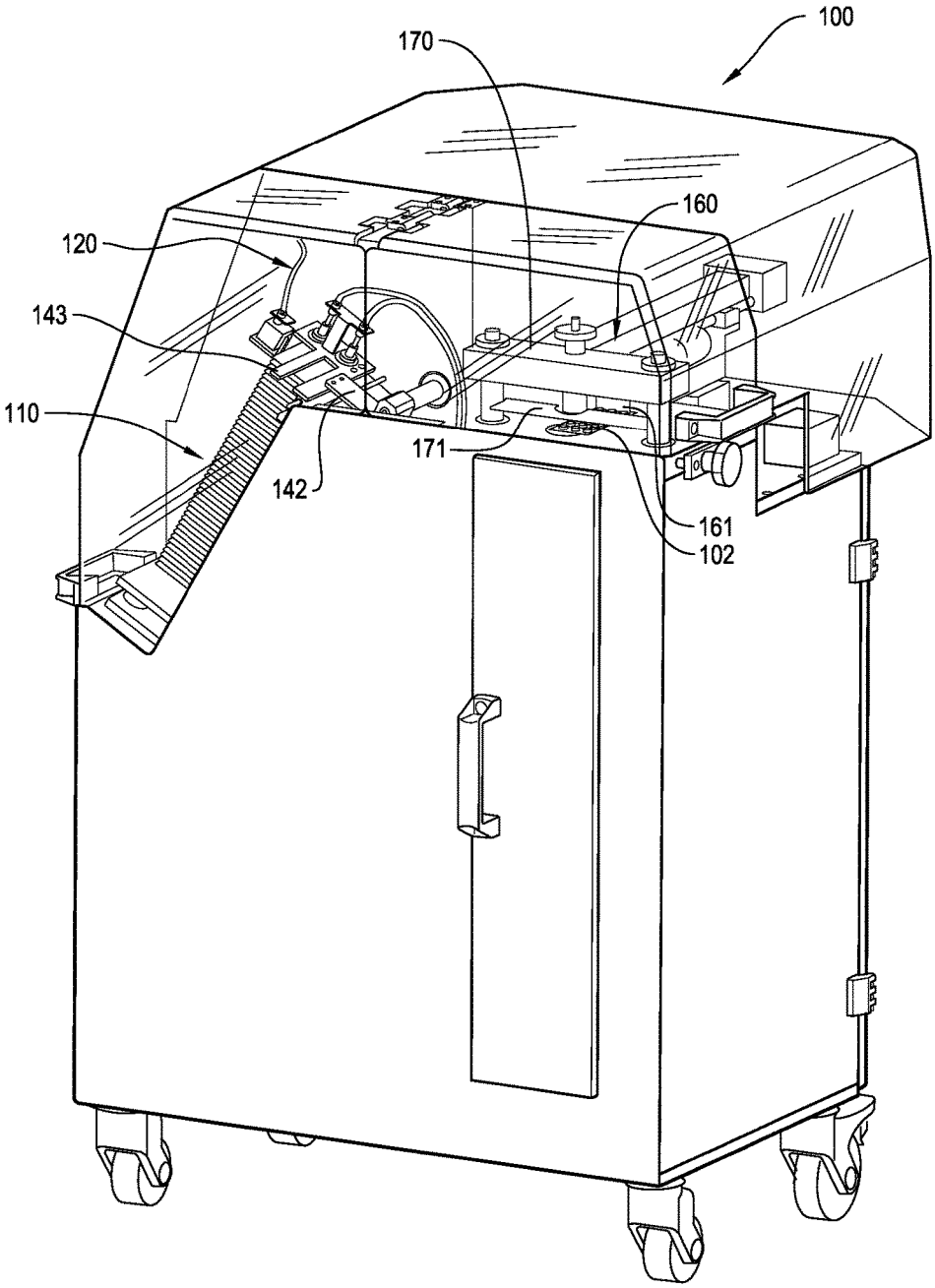
FIG. 1 is a general isometric view of the cutting machine in accordance with the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices illustrated in the attached drawings, and described in the following specification, are simply exemplary embodiments of the inventive concepts defined in the appended claim. Hence, specific dimensions and other physical characteristics relating to the embodiments disclosed herein are not to be considered as limiting, unless the claims expressly state otherwise.

Making reference to FIGS. 2A-F, the unidose blister cutting machine 100 comprises a blister pack-feeding cartridge 110 for holding and feeding the blister packs 101 to be processed. The blister pack that is located at the top of the pile is numbered as upper pack 102. A first positioning arm 120 is capable of pushing one blister pack 101 at a time in a first direction; a second positioning arm 130 capable of pushing the blister pack 101 in a second direction substantially orthogonal to the first direction; a flipping robotic head 140, a positioning device 160 capable of grabbing one blister pack at a time from the flipping robotic head 140; a cutting device 170, and a collecting chute 180 located below the cutting device capable of collecting the cut blister packs 101.

Figure 6:
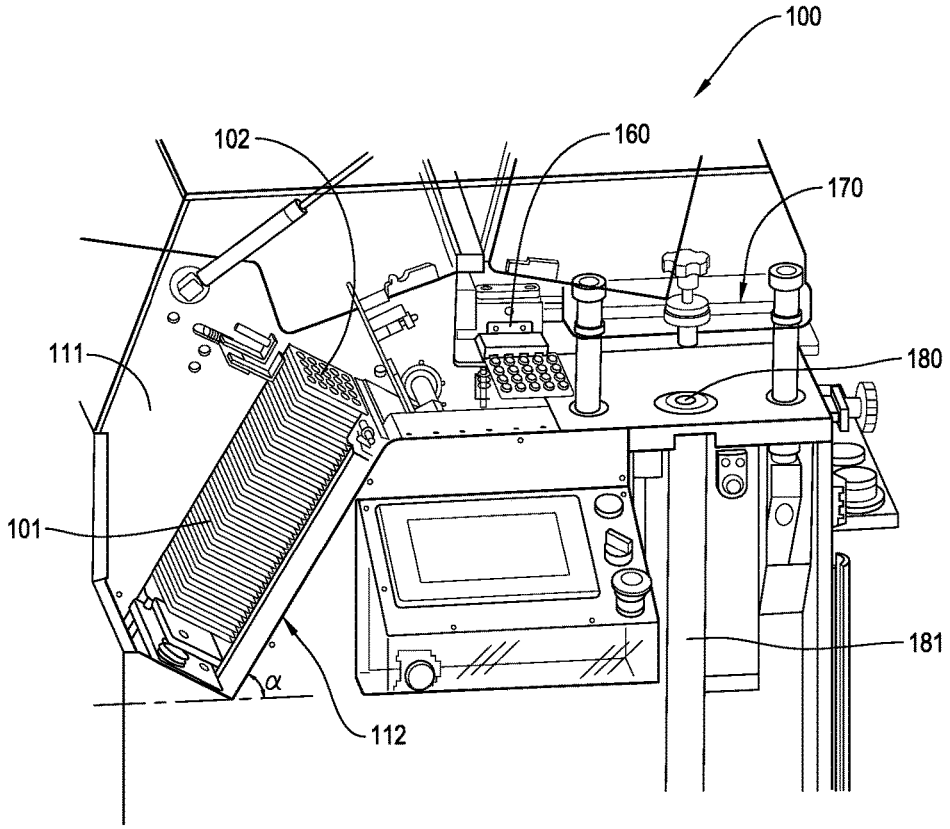
FIG. 6 is a general perspective view of the main parts of the system, while blister packs are being processed.

Said cartridge 110 comprises a lateral guiding wall 111 and a movable base 112. A group of blister packs 101 may be laid on said guiding wall 111 and the base 112, which is coupled to driving means (not illustrated) capable of lifting or descending this base 112 as explained below. When the blister packs 101 are positioned in the cartridge, each blister pack 101 is placed at an angle of around $\alpha$ of 10-30° (see FIG. 6). Said guiding wall 111 aligns and guides the blister packs 101 during the ascending and descending movement.

The first positioning arm 120 comprises a pushing head 121 and a moving mechanism 122 (not illustrated in detail) capable of moving said pushing head 121 back and forward and thus pushing the upper blister pack 102 in a first direction.

The second positioning arm 130 comprises a pushing head 131 and a moving mechanism 132 (not illustrated in detail) capable of moving said pushing head 131 and pushing said upper blister pack 102 in a second direction substantially orthogonal to the first direction. The action of both positioning arms 120-130 places the upper blister pack 102 in a position where the flipping robotic head 140 can take it. The position of the blister pack 102 in the right position is the combination of three independent but coordinated movements: the lifting movement of the base 112, the pushing action of head 121 and the pushing action of head 131.

Figure 2A:
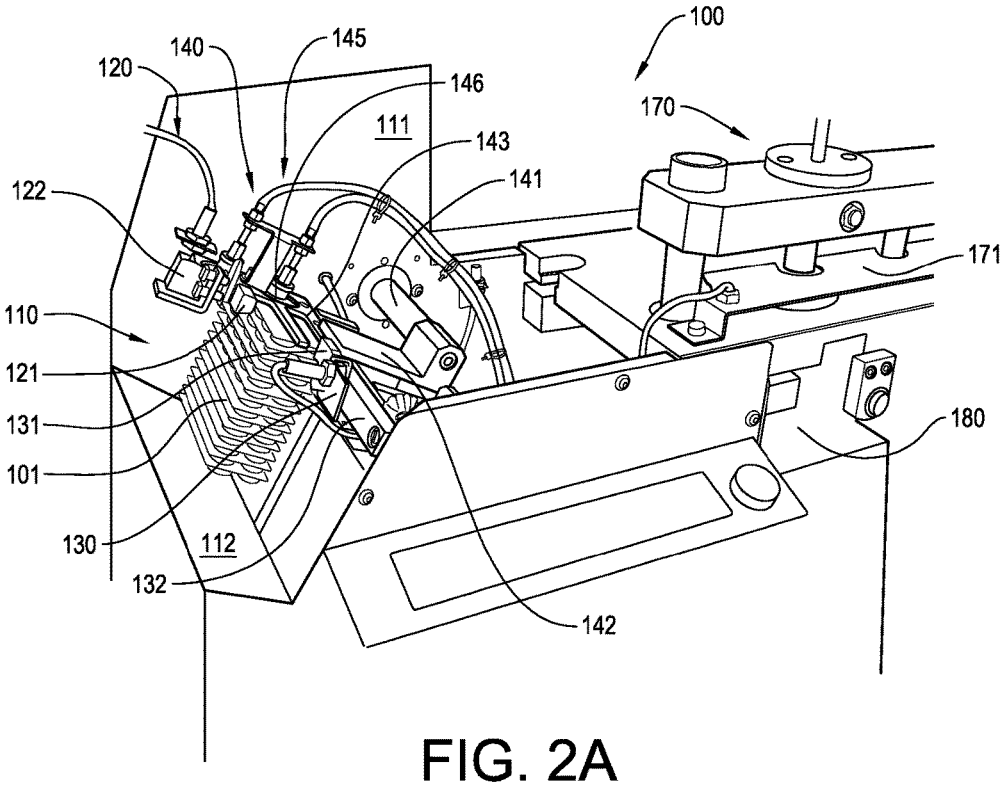
FIGS. 2A-2F are respective perspective views of the machine showing from the first to the final stage of the unidose repacking process.
Figure 2B:
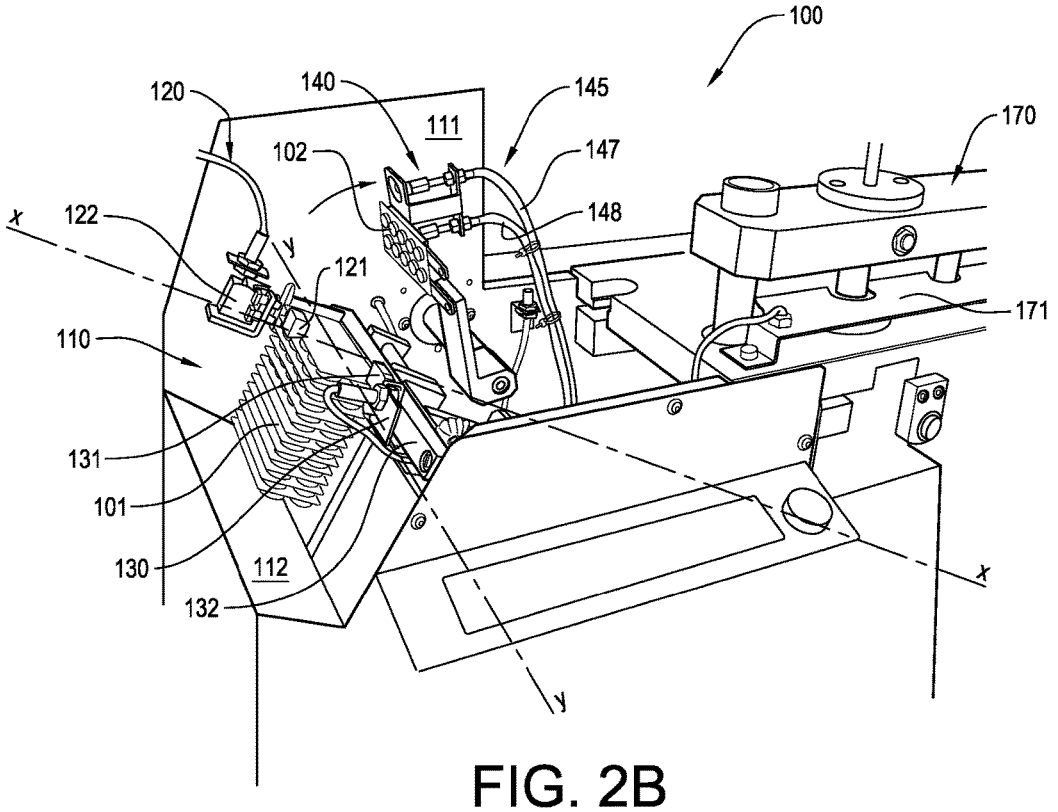
Figure 2C:
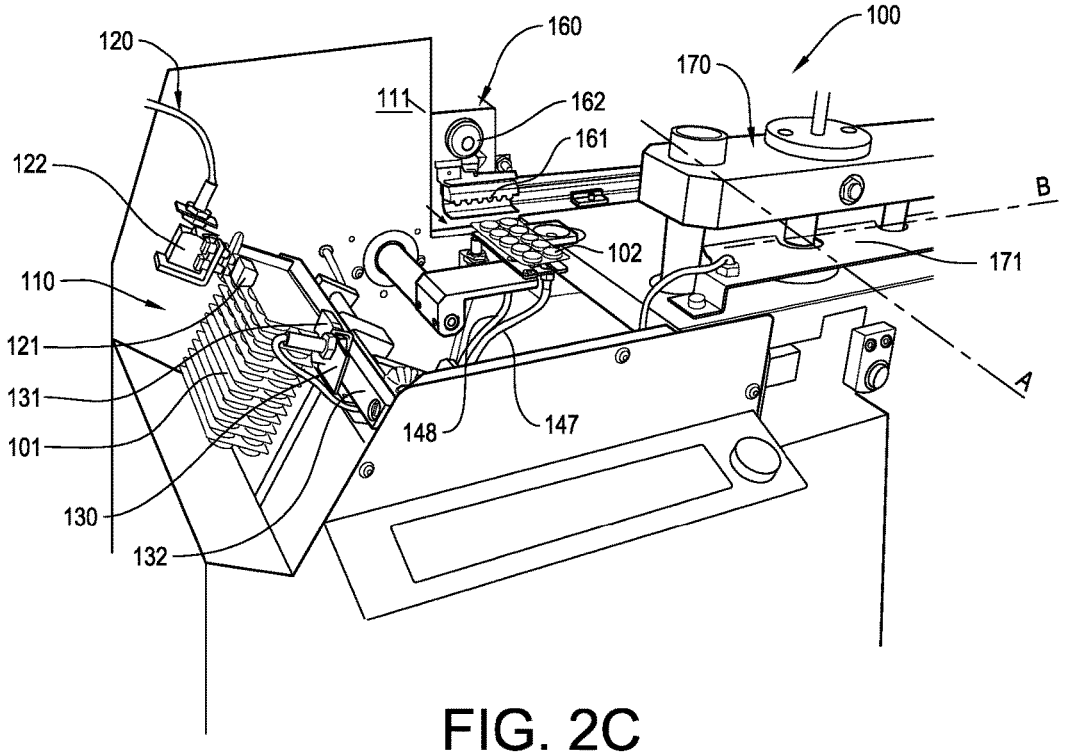
Figure 2D:
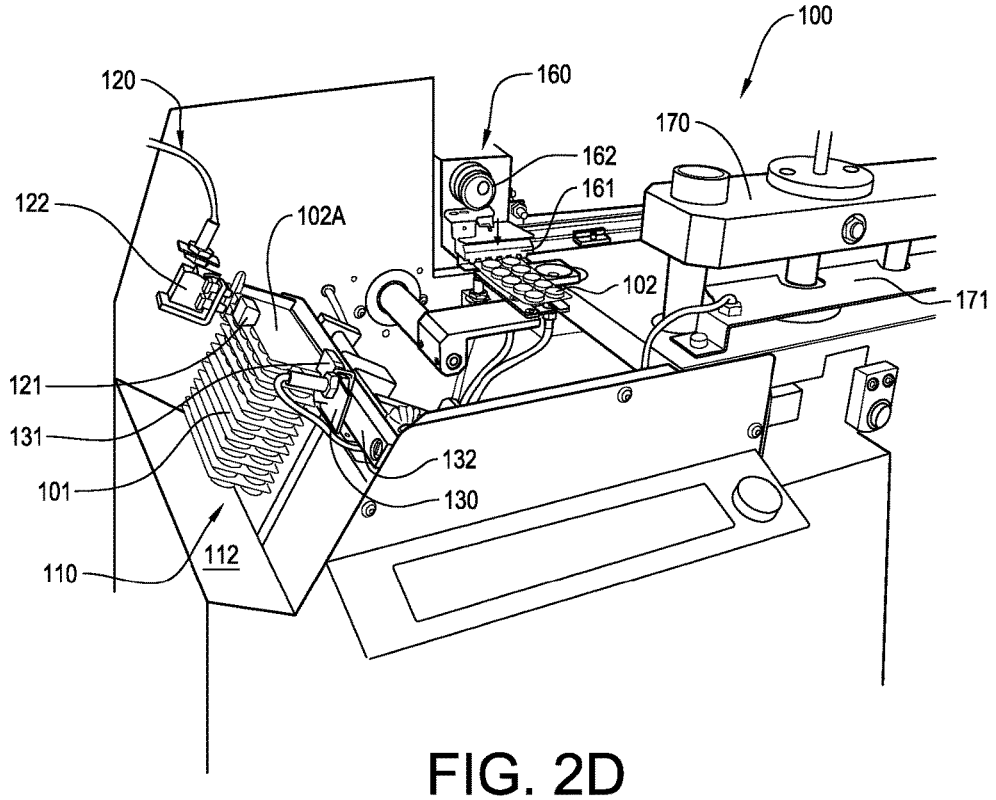
Figure 2E:
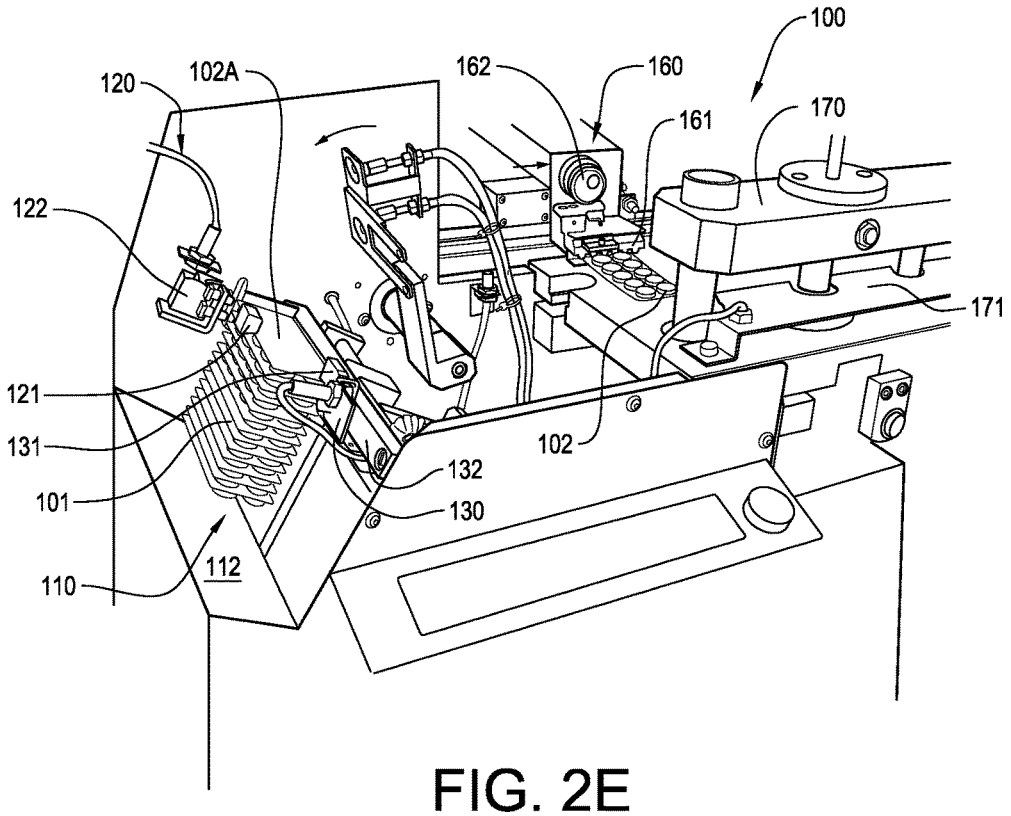
Figure 2F:
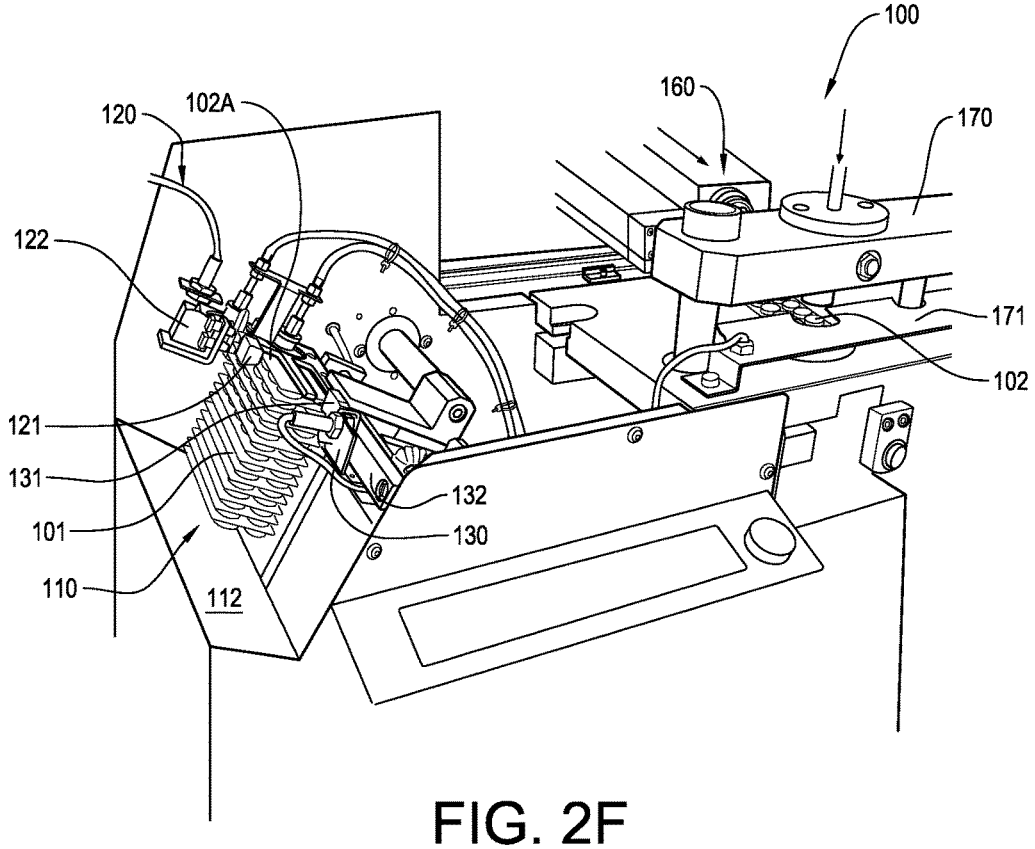

As illustrated in FIG. 2A, the pile of blister packs 110 is in position to start the process in accordance with the following detail:

a. The first movement is the lifting movement of the base 112 until the upper blister pack 102 on top of the pile reaches the top position. This base 112 is moved by a step motor mechanism (not illustrated).
b. As illustrated in FIG. 2B the step motor driving mechanism 122 moves the head 121 in the direction of axis X and said head 121 pushes the edge of the blister pack 102 in the direction of axis X. When the blister pack 102 reaches the desired point, the step motor mechanism 122 is activated in the opposite sense and the head 121 returns to its original position.
c. The step motor driving mechanism 132 moves the head 121 in the direction of axis Y (FIG. 2B) pushing the edge of the upper blister pack 102 in the direction of axis Y. When the blister pack 102 reaches the desired point, the step motor mechanism 132 is activated in the opposite sense and the head 121 returns to its original position.

Thus, the system 100 levels the blister packs 111 up to a top position in which it will be taken to the next step, without using excessive pressure on it. The base 112 and said heads 121-131 can be driven by different mechanisms, including but not limited to, step motor driving mechanisms, hydraulic driving mechanisms, motors, etc. By means of these driving means and a software, the system 100 can align any size of a blister pack 101 automatically, keeping it in an exact position to be taken by a grip in the next step. When the user needs to change the size of the blister pack, it is not necessary to make any changes or regulations between one size and the other in the feeding cartridge 110.

Said flipping robotic head 140 comprises an axis 141, a flipping arm 142 and a C-shaped flat head 143 attached to said flipping arm 142. Said axis 141 is coupled to a driving device (not illustrated) capable of rotating said flipping arm 142 clockwise and counter-clockwise. At the outer end 144, said C-shaped flat head 143 includes a vacuum device 145 that comprises a suction cup 146, and two suction hoses 147-148 connected to a vacuum pump (not illustrated). When the blister pack 102 is in the right position (that is, when the pushing heads 121-131 positioned it in are in the correct place), the vacuum pump is activated, creating a suction effect on the suction cup 146. When this suction cup 146 is in contact with the flat surface 102A of the blister pack 102, the blister pack 102 is retained or sucked by the suction cup 146 of the C-shaped flat head 143. The suction pressure is high enough to keep the blister pack 102 in position during the flipping movement of the arm 142. Thus, the C-shaped flat head 143 of the flipping arm 140 takes the blister pack 102 and holds it (by vacuum), rotating it and taking it to the next operation.

Before releasing the vacuum, the blister 102 is taken by the positioning device 160. This device 160 comprises a grabbing jaw 161 and an operating arm 162 coupled to a step motor device (not illustrated) capable of moving the grabbing jaw in an X-Y plane (FIG. 2B and FIGS. 3A-H). The main purpose of this positioning device 160 is to place the blister pack 102, and particularly each cavity 103 of said blister pack 102, below a cutting device 170. This positioning device 160 is controlled by a software capable of storing the arrangement and number of cavities of each blister pack as well as determining the exact position of the cavity to be cut and separated from the blister pack, and controlling all the moving parts of the machine 100. The device 160 moves and places the blister pack ready for the cut to take place. When the cutting device 160 cuts and separates one cavity 103 from the blister pack, the device 160 moves the blister 102 again to place the next cavity 103 right below the cutting device 170.

Figure 3A:
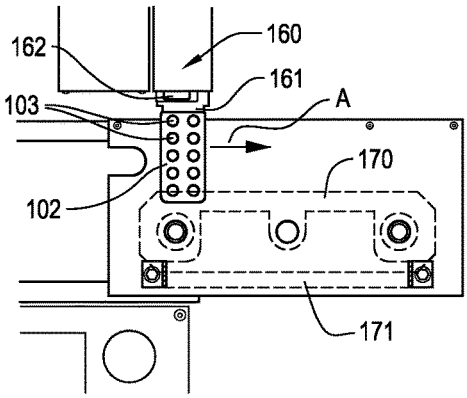
FIGS. 3A-3H are respective top plan view showing how the blister pack is moved through the process and the individual blisters are cut out defining an individual dose.
Figure 3B:
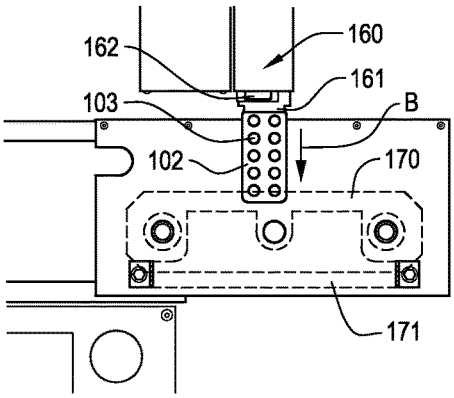

FIGS. 3A-H clearly show how the blister pack is moved during the cutting process. FIG. 3A shows when the blister pack is moved horizontally from the previous step described above to the initial positioning of the cutting process. Arrow "A" shows this horizontal movement. When the blister pack 102 reaches the initial position of FIG. 3B the device 160 moves it vertically, as indicated by arrow "B". Since the cutting device is fixed, the blister pack 102 and particularly the cavity 103 to be cut out needs to be positioned right below the cutting die 171. The device 160, controlled by mechanical means and a software, will be the one in charge of positioning the blister in the cutting position.

Figure 3C:
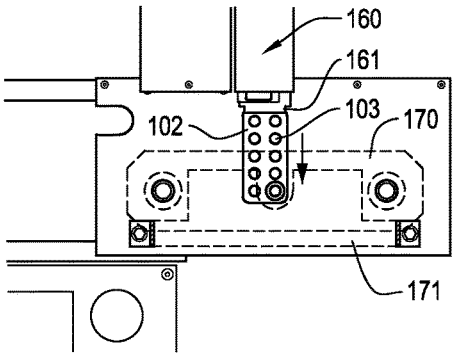
Figure 3D:
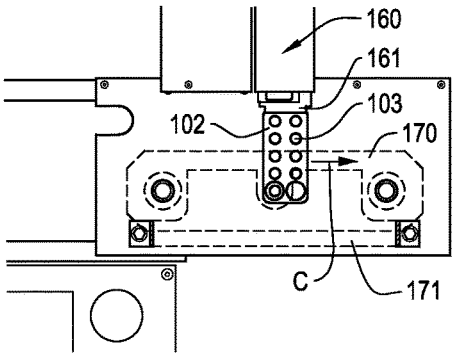
Figure 3E:
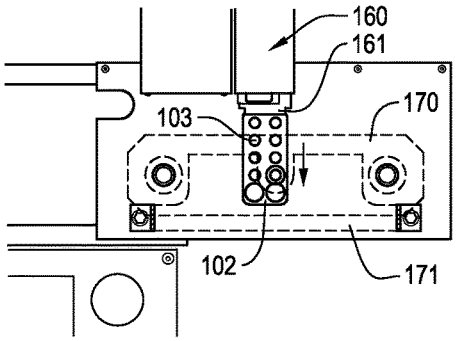
Figure 3F:
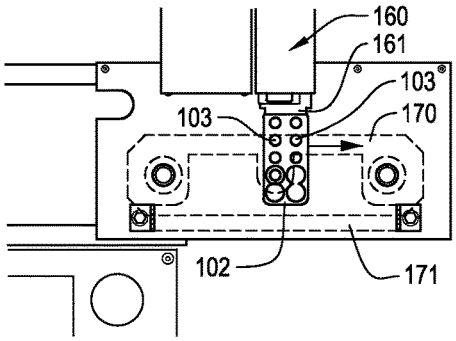
Figure 3G:
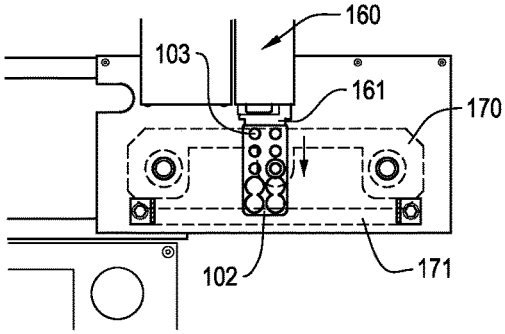
Figure 3H:
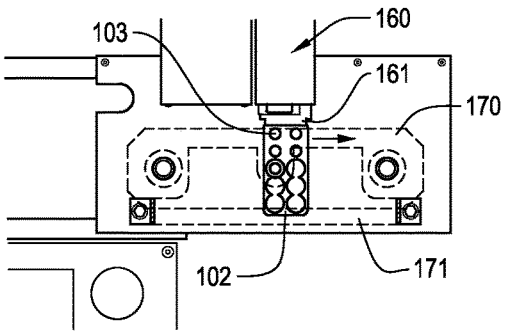
Figure 5:
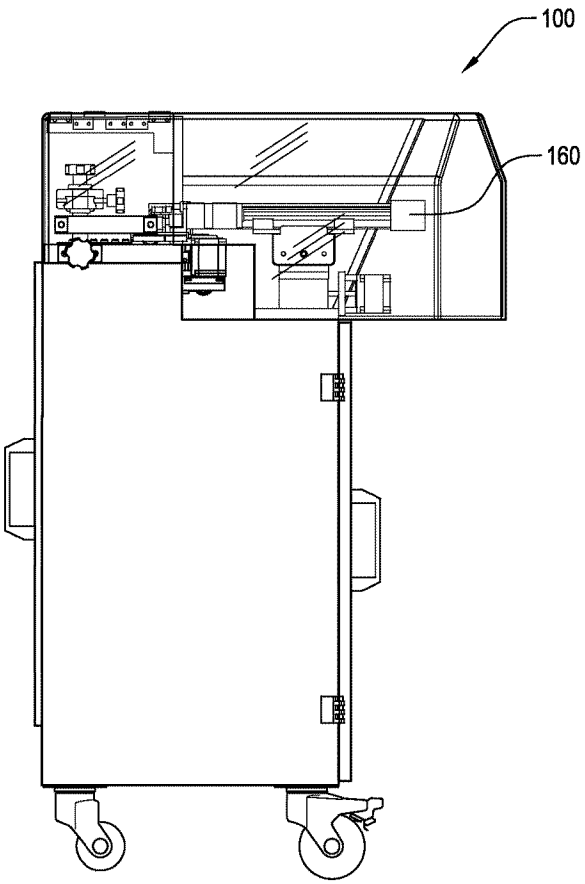
FIG. 5 is a right side elevational view thereof.
Figure 4:
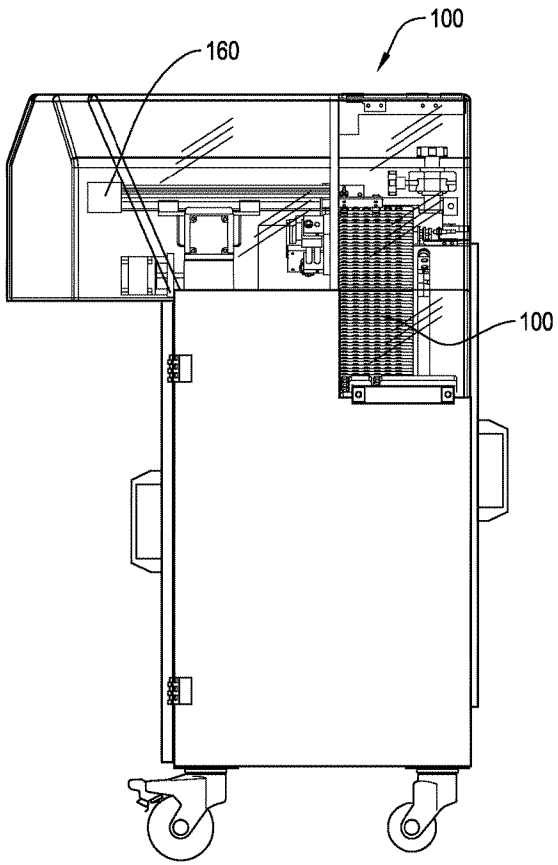
FIG. 4 is a left side elevational view thereof.

FIG. 3C shows the exact position where the first cavity 103 is cut out of the blister pack by the cutting device 170. In FIG. 3D the first cavity 103 is already cut out and the device 160 is moving the blister 102 to the right (arrow C) so as to position the second cavity right below the cutting die 171. In FIG. 3E the first two cavities are gone and the device 160 moves again the blister 102 to position the third cavity right below the cutting die of the cutting device 170. The process is repeated until all the cavities are cut from the blister and the system returns to the original step to grab a new blister and re-start the process.

Figure 7:
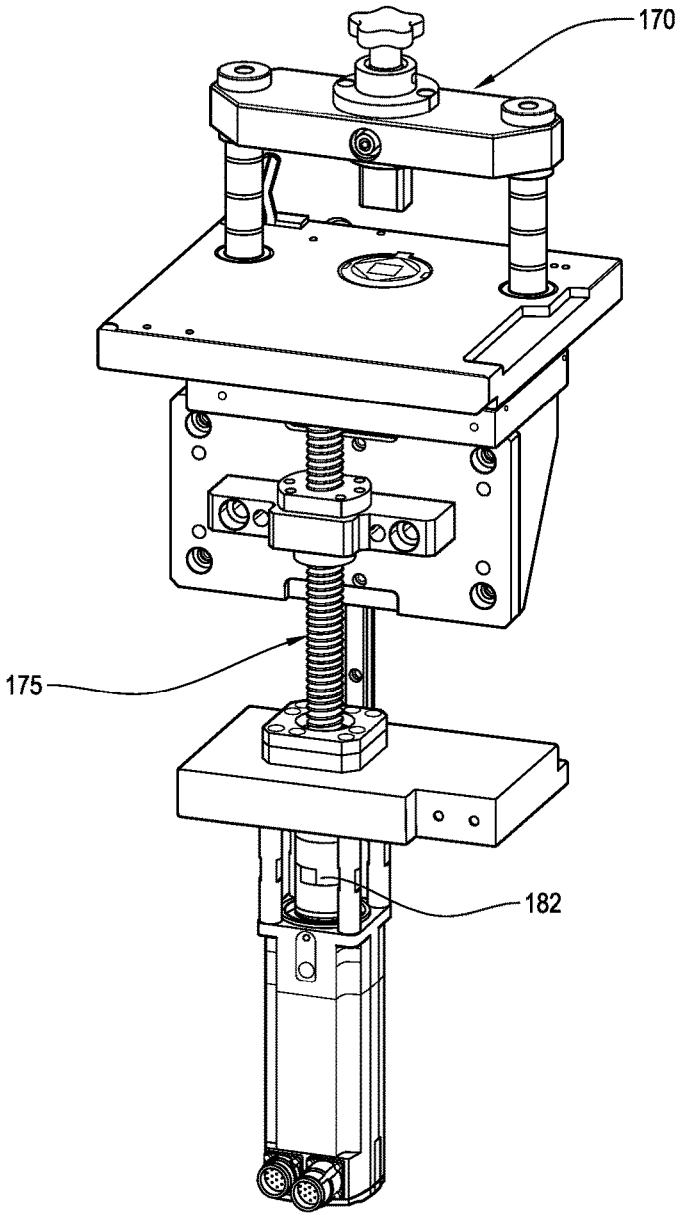
FIG. 7 is a general perspective view of the cutting device 170 in which the rest of the machine's parts have been taken away to show clearly the ball bearing screw 175 that drives said cutting device.

The cutting device 170 is actuated by a servomotor 182 (illustrated) in FIG. 7, with a ball bearing screw 175 that moves up and down the cutting die 171. Since the cavities of the blister packs may have different shapes, different cutting dies with different shapes can be used, including but not limited to, rounded, oval, and rectangular with rounded edges, etc. The shape of each die must copy the shape of the cavity to be cut out.

A collecting chute 180 including a tube 181 (FIG. 6) receives the cavities already cut, which in turn are being pushed into a collecting bucket (not illustrated) for further processing.

While the preferred embodiments of the invention have been described above, it will be recognized and understood that various modifications can be made in the invention and the appended claims are intended to cover all such modifications which may fall within the spirit and scope of the invention.

What is claimed is:

1. A unidose blister cutting machine comprising:

a cartridge for holding a stack of blister packs to be processed, each blister pack having a plurality of cavities;

a first positioning arm for pushing a blister pack in a first direction;

a second positioning arm for pushing the blister pack in a second direction substantially orthogonal to the first direction;

a flipping robotic arm having a suction means for retaining the blister pack during a flipping movement, the flipping robotic arm flipping the blister pack from the cartridge;

a grabbing jaw for grasping the blister pack from the flipping robotic head;

a cutting device for cutting the blister pack into individual cavities; and a collecting chute located below the cutting device for collecting the cut cavities.

2. The machine of claim 1, wherein the cartridge for holding the blister packs includes at least one lateral guiding wall and a movable bottom base.

3. The machine of claim 2, wherein the movable base is a flat platform with a top surface where the blister packs to be processed are laid and a bottom surface coupled to a step motor.

4. The machine of claim 1, wherein the first positioning arm comprises a step motor piston coupled to a pushing head.

5. The machine of claim 1, wherein the second positioning arm comprises a step motor piston coupled to a pushing head.

6. The machine of claim 1, wherein the flipping robotic arm comprises a step motor coupled to a flipping axis to which a flipping arm with a C-shaped head is attached which, in turn, includes the suction means.

7. The machine of claim 6, wherein the suction means includes a vacuum pump connected to two hoses also attached to a suction cup that is part of the C-shaped head.

8. The machine of claim 1, wherein the grabbing jaw comprises a metallic toothed-jaw a coupled to a driving arm which in turn is coupled to a driving mechanism, for grabbing the edge of the blister pack and moving if sequentially below the cutting device.

9. The machine of claim 1, wherein the cutting device is defined by a cutting die actuated by a servomotor with a ball bearing screw.

10. The machine of claim 9, wherein the shape of the die can be selected from: rounded, a oval, or rectangular with rounded edges.

11. The machine of claim 9, wherein the shape of the die corresponds to the shape of the cavity to be cut.

12. The machine of claim 1, wherein the collecting chute includes a tube for receiving the cavities already cut, which in turn are pushed into a moving piece that keep them in a pile.

* * * * *